United States Patent [19]

Musgrove

[11] Patent Number: 4,566,140

[45] **Date of Patent: * Jan. 28, 1986**

[54] SELECTIVE FLUSH CISTERN

[75] Inventor: Neil R. Musgrove, New South Wales, Australia

[73] Assignee: James Hardie Industries Limited, New South Wales, Australia

[ * ] Notice: The portion of the term of this patent subsequent to Jul. 9, 2002 has been disclaimed.

[21] Appl. No.: 616,313

[22] Filed: Jun. 1, 1984

Related U.S. Application Data

[63] Continuation-in-part of Ser. No. 547,745, Nov. 1, 1983, Pat. No. 4,527,296.

[30] Foreign Application Priority Data

Jun. 8, 1983 [AU] Australia ..... PF9747

[51] Int. Cl.[4] ..... E03D 1/14

[52] U.S. Cl. ..... 4/324; 4/364; 4/410; 4/413; 4/415

[58] Field of Search ..... 4/324, 325, 364, 378, 4/392–394, 395, 405, 410–415

[56] References Cited

U.S. PATENT DOCUMENTS

| | | | |
|---|---|---|---|
| 3,345,649 | 10/1967 | Cabra | 4/410 |
| 4,143,430 | 3/1979 | Joshi et al. | 4/364 |
| 4,219,895 | 9/1980 | Thompson | 4/410 |

*Primary Examiner*—Stephen Marcus
*Assistant Examiner*—Linda J. Sholl
*Attorney, Agent, or Firm*—Weingarten, Schurgin, Gagnebin & Hayes

[57] ABSTRACT

A sanitary pan flush cistern which includes structure to permit full-flush or partial flush as required. The cistern is a conventional lidded container housing usual outlet valve on a valve-rod, a press-button in the lid to open the valve and a float-controlled water admission valve. It also houses a pot which in turn houses the outlet valve, and has a normally open doorway furnished with a lid. Linkage connects both the lid and the valve-rod to the press-button so that when the latter is pressed the valve is opened and a full flush passes the outlet valve from the pot and from the outer vessel by way of the normally-open door. When the press-button is lifted the outlet valve opens as before but the door is closed so that the flush is limited to the content of the pot. In accordance with the invention the linkage is length adjustable and the press-button preferably non-rotatable.

4 Claims, 10 Drawing Figures

SELECTIVE FLUSH CISTERN

CROSS REFERENCE TO RELATED APPLICATIONS

This application is a continuation-in-part of a previously filed copending application entitled "SELECTIVE-FLUSH CISTERN," Ser. No. 547,745, filed Nov. 1, 1983 now U.S. Pat. No. 4,527,296.

This invention relates to cisterns for the water flushing of sanitary pans. More particularly, selective-flush cisterns of the kind making provision not only for a full water flush, but also some fractional flush as the user may elect. More particularly, the invention is an improvement of the selective flush cistern described and claimed in our prior made co-pending patent application Ser. No. 547,745.

The cistern operating arrangements of the said prior applications is referred to as the parent invention hereinafter.

An object of this invention is to provide a selective-flush cistern operating mechanism which is better adapted for installation in an existing single-flush cistern without need for modification thereof by comparison with the parent invention.

In summary, the parent invention provided a selective-flush operating mechanism for a cistern of the kind comprising:

a cistern body having a bottom discharge drain and a lid having a hole in it, a closure valve normally seated on said drain, a single press-button which extends through said hole, valve lifting means which upon said press-button being depressed causes said valve to be lifted from said drain, a float whereby said valve is held elevated once lifted and allowed to re-seat on said drain upon conclusion of a flush, and float-controlled means for water-replenishment of said body; characterised in that said mechanism comprises:

(a) an open-top partial-flush pot within said body and which contains the top aperture of said drain, said valve and said float, and has a doorway open to the inside of said body adjacent its bottom, (b) a normally open door having a trickle opening in it which, except for that opening, is able to close said doorway; and, (c) linkage operatively connecting said press-button with said valve and said door, such that on lifting said press-button said valve is lifted and said door is closed, wherein said linkage is length adjustable to permit adjustment of the overall height of the mechanism.

Examples of the parent invention are illustrated, more or less schematically, in FIGS. 1 to 10 of the drawings herewith.

Figure 1:
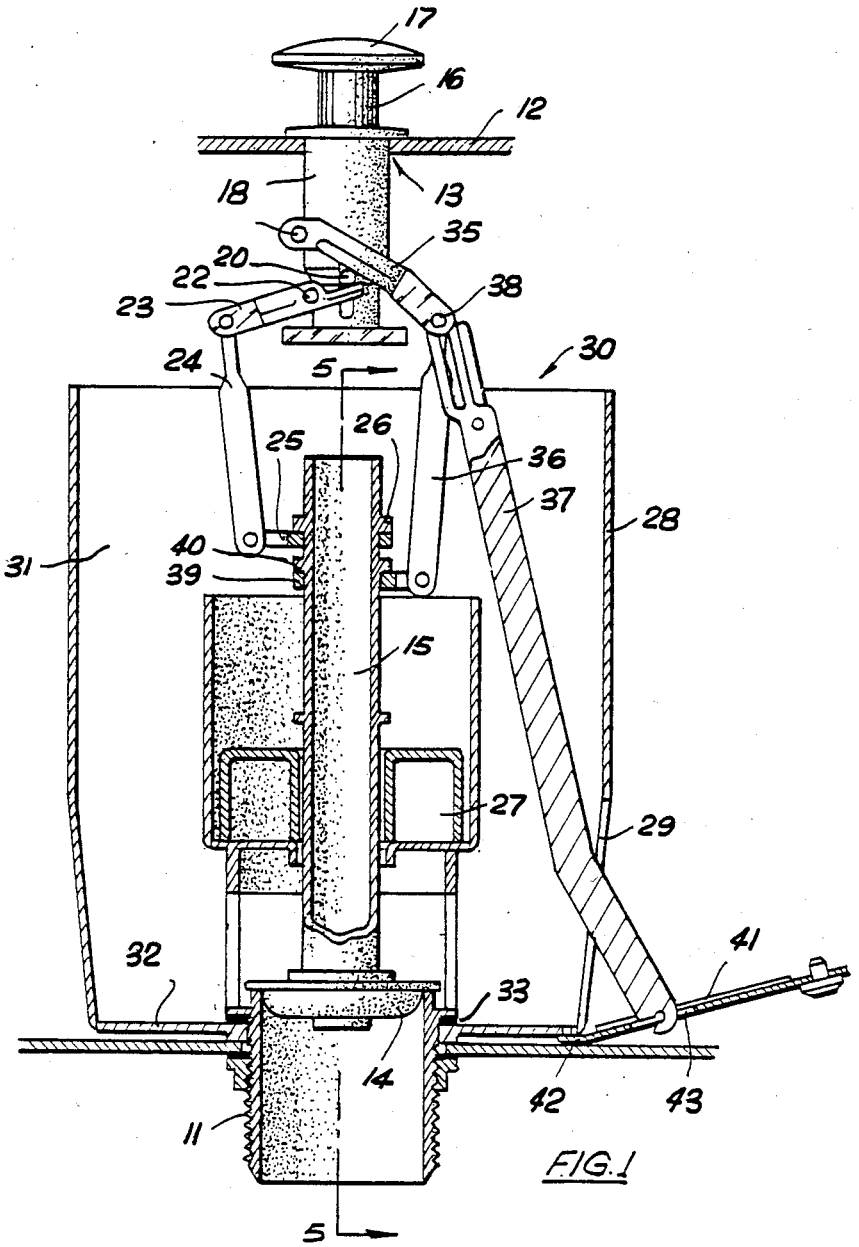
FIG. 1 is an incomplete partly-sectioned side elevation of the mentioned pot, and parts associated with it, with its door open.
Figure 2:
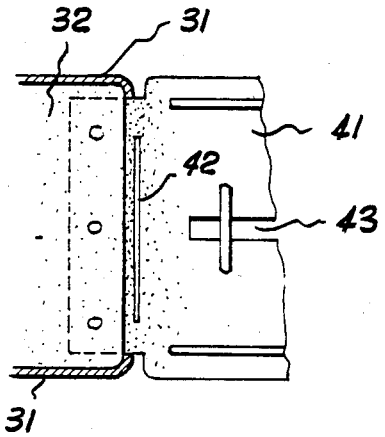
FIG. 2 is a fragmentary plan of the bottom right-hand portion of FIG. 1 with the door closed.
Figure 3:
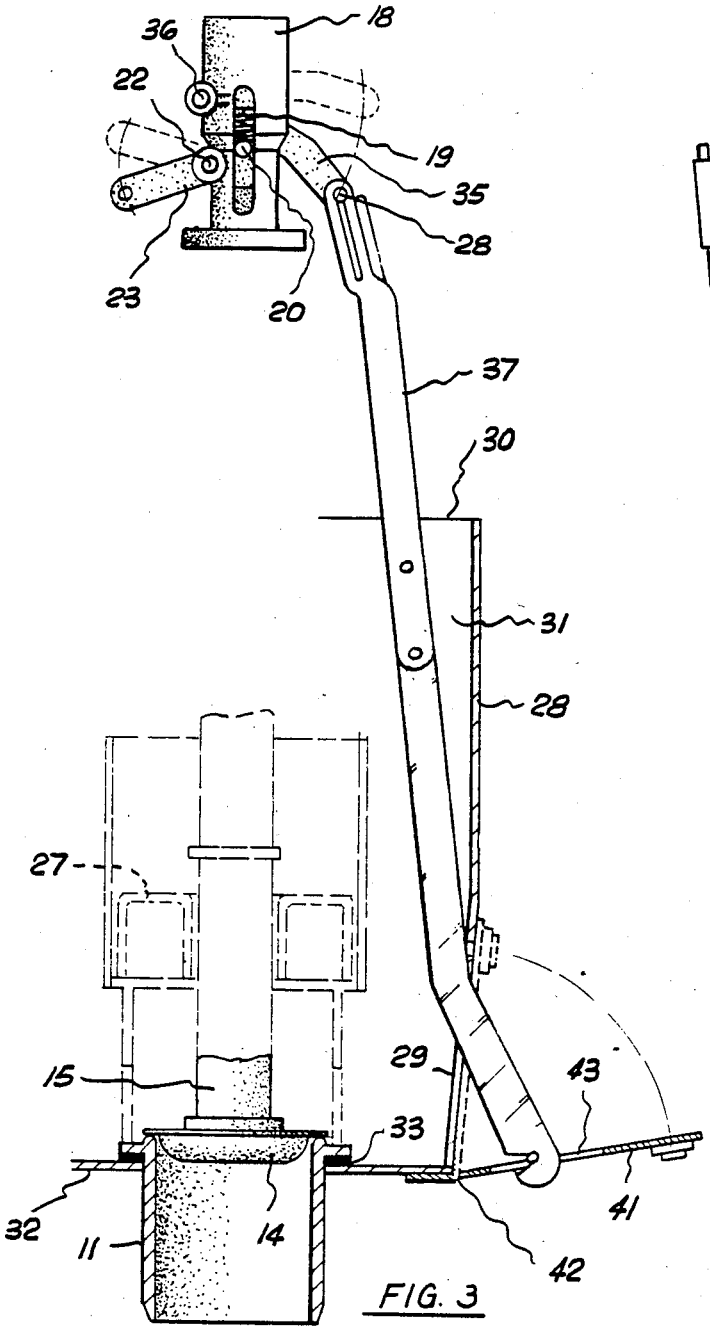

FIG. 3 largely repeats FIG. 1 on a somewhat enlarged scale.

Figure 4:
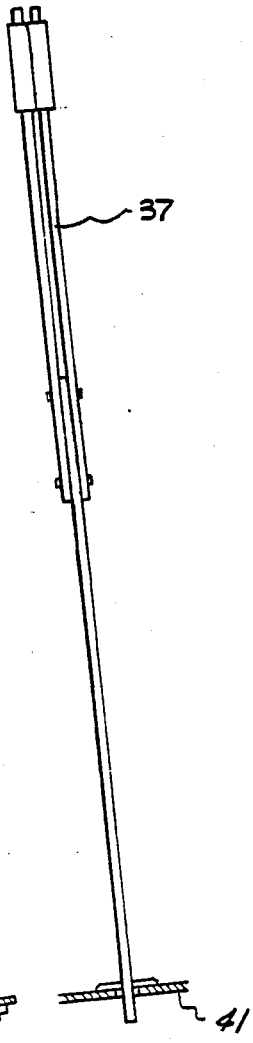

FIG. 4 is an end elevation of a connecting link shown in FIG. 3.

Figures 5, 6:
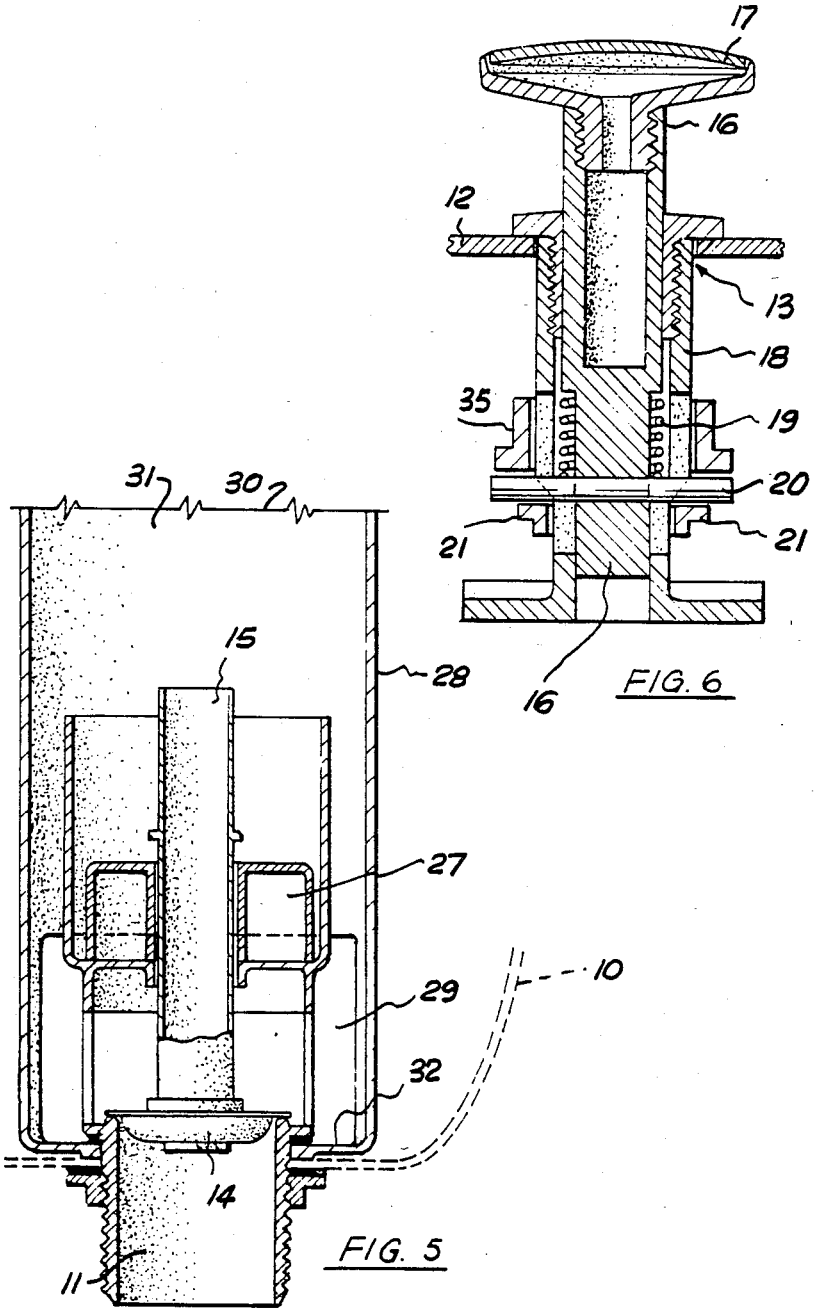

FIG. 5 is a detail of a drain shown in FIGS. 1 and 3.

FIG. 6 is a sectional detail of a press-button.

Figure 7:
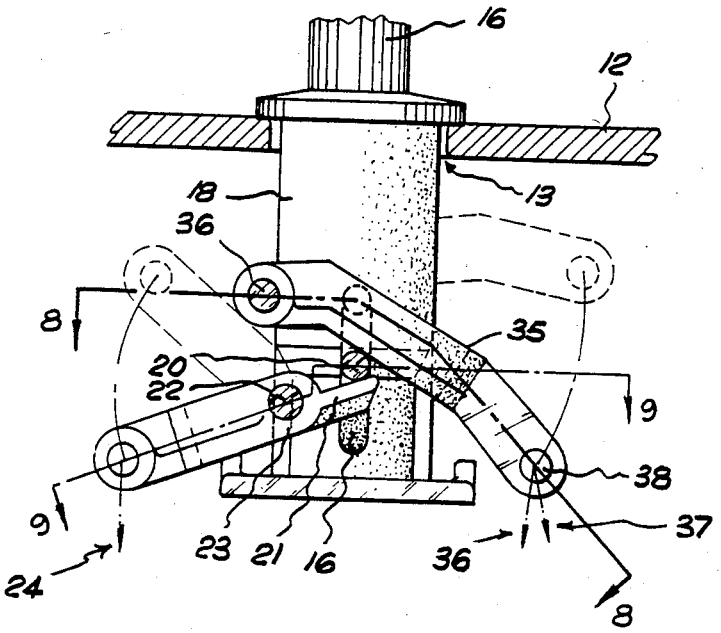

FIG. 7 is a detail of operating levers associated with the press-button.

Figure 9:
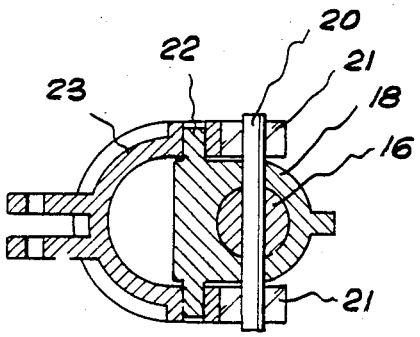
Figure 8:
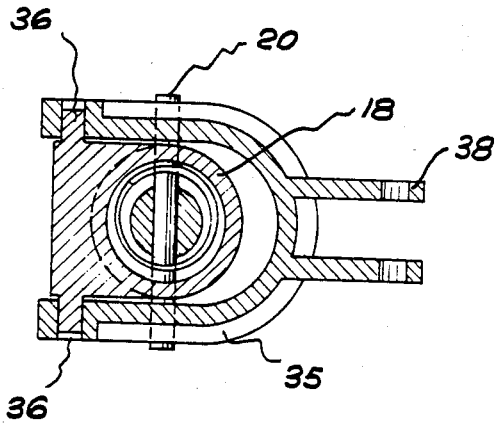

FIGS. 8 and 9 are sectional plans respectively taken on lines B—B and A—A in FIG. 7.

Figure 10:
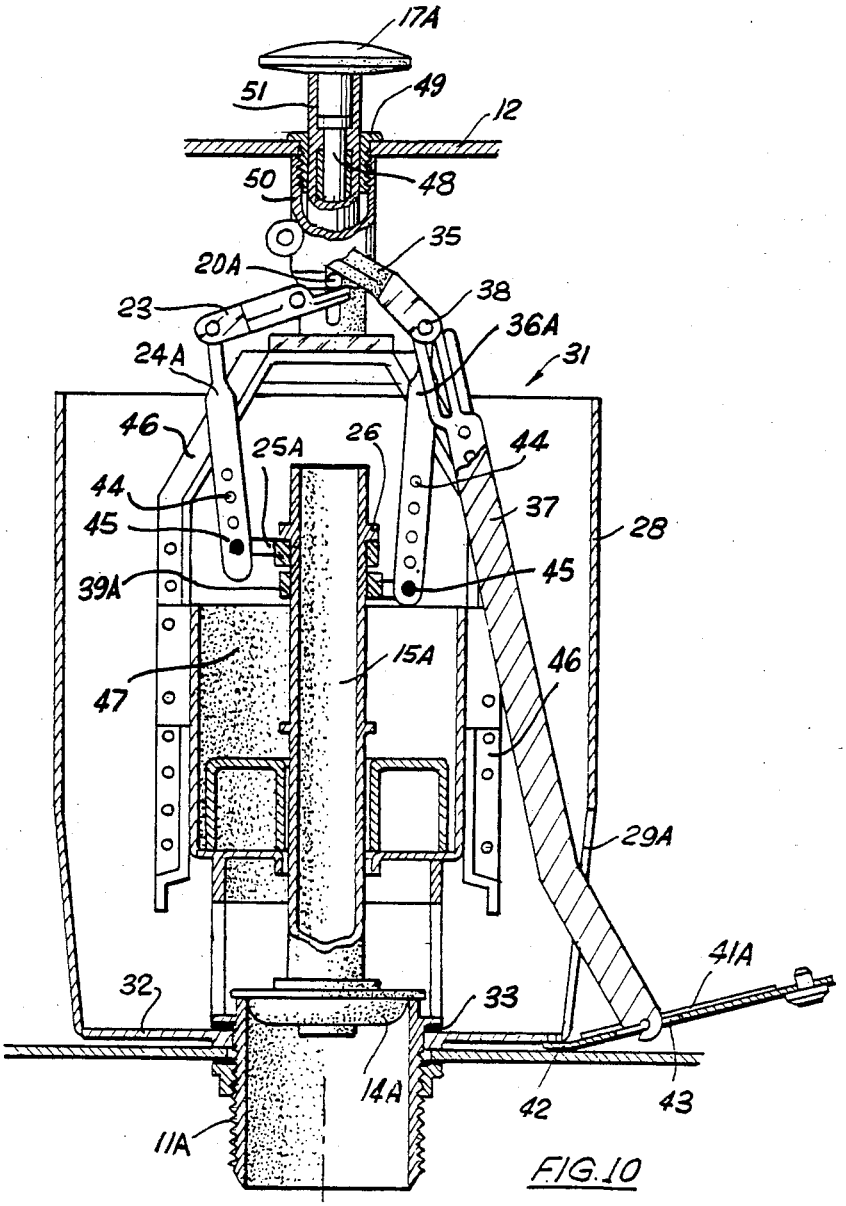

FIG. 10 is a view similar to FIG. 1 but for showing the constructional modifications of the present invention.

Referring to FIGS. 1 to 9 of the drawings, a cistern body 10 has a bottom drain 11 and a lid 12 having a hole 13 in it.

A closure valve 14 is normally seated on drain 11 as shown in FIG. 5. Valve 14 is mounted on the lower end of a vertically movable operating stem 15.

A press-button 16 has a lifting knob 17 and extends through hole 13. It is vertically movable in a guide tube 18 and is preferably lightly spring loaded (as indicated at 19) so that it is influenced to remain elevated.

Button 16 carries a through-pin 20 which bears upon one arm 21 of a first stirrup lever fulcrumed at 22. The other arm 23 of this lever is connected by link 24 to a first lifting collar 25 which loosely encircles stem 15, being placed directly under a first abutment collar 26 fixed on stem 15.

An inverted-cup type of float, indicated at 27, is provided in conventional association with stem 15. Its purpose being to hold valve 14 elevated once it has been lifted and then permit that valve to fall back into closure position (on drain 11) when the float is no longer buoyed due to a flush operation nearing its end.

The cistern body is, of course, provided with usual float-controlled means whereby the cistern body is water replenished after a flush.

The arrangement, as thus far described, is largely of conventional kind and would certainly be operable in conventional manner to deliver a full flush charge. This would be effected simply by depressing button 16. This, in turn, would lower pin 20 thus to raise collar 25 and with it stem 15. The consequent lifting of valve 14 from drain 11 would initiate a full flush consisting of water contained in pot 28 (yet to be described) and water in the body 10 passing into pot 28 through normally-open doorway 29.

When the flush comes to an end, valve 14 re-seats on drain 11 gravitationally and the conventional float-control means operate to replenish body 10 and with it pot 28; again by way of open doorway 29.

Pot 28 has an open top 30 and consists of side walls 31 and floor 32 with a hole in it to encircle drain 11 by which the pot is held in position, as shown in FIG. 5, gasket washers 33 and 34 being provided also as indicated in FIG. 5.

A second stirrup lever 35 is fulcrumed at 36 and rests on through-pin 20. Lever 35 has two links 36 and 37 pivoted to its free end 38. Link 36 is connected to a second lifting collar 39 placed about stem 15 under second abutment collar 40 on that stem.

Link 37 is hooked on to door 41 hinged on the pot 28 at 42 and able to close door 41 onto doorway 29. This closure is not absolute since door 41 has a trickle opening 43 in it. The purpose of this opening will be explained later herein.

When a fractional flush is required, the press-button 16 is lifted. This raises the free-end 38 of lever 35 thus hauling upon both of the links 36 and 37. Link 36, by lifting stem 15, will open valve 14, and, at the same time, link 37 closes door 41 on doorway 29. Thus a flush takes place which is limited to the contents of pot 28 plus such small amount as may trickle into the pot through opening 43. The rate of this trickle depends on the area of opening 43. This area is selected to ensure that the in-trickle will not be enough to prevent emptying of pot 28 resulting in closure of valve 14 when the required fractional-flush has passed through it.

The height of pot 28 is not critical, since its top rim may be above or below the level of replenishment the float-controlled means normally establish. If top 30 is below replenishment it only means that water above the level 30 participates in both kinds of flush; and, to some extent, this may be relied upon for replenishment of pot 28 following a fractional-flush. For preference however trickle opening 43 is provided so that top water level in both pot and body will equalize if door 41 should remain closed.

Normally this door 41 will fall open gravitationally when free to do so, but when (after a fractional flush) the water pressure in the body is greater than that in the pot, the door will tend to keep closed, and if it should stay that way and does not have a trickle opening, no further flushing could take place until the door was opened by external means. Hence the preference for a trickle opening such as 43.

It will be appreciated that under normal operation for full flush, the door 41 will simply remain open during both flush and replenishment and operation will go forward as though the pot 28 and the other means for fractional flush were not present.

On the other hand, during operation for fractional flush door 41 will tend to remain closed owing to external pressure, but this will be relieved by trickle flow into the pot or (if wall 28 is not too tall) by spill over its rim. In any case, replenishment by way of the float-controlled means, will be dependent upon the water head in the body as distinct from that in the pot.

The arrangement according to the present invention shown in FIG. 10 is much the same as that shown in FIG. 1 except for its inclusion of means permitting the effective overall height of the closure valve mechanism to be adjusted to suit existing cisterns of differing internal heights; and also, means to ensure against rotation of the "press/lift" knob (marked 17 in FIG. 6). This latter provision is preferred because the arrangement is expected to be installed largely in existing, conventional cisterns, so that, because of their usual appearance, users may remain unaware that the knob may be lifted (to initiate a partial flush) as distinct from merely being depressible, in the conventional way, for full flush.

Thus it is desirable for the top of the knob to carry an instruction such as:

"PRESS FOR FULL FLUSH—LIFT FOR PARTIAL FLUSH";

and, with such an instruction, it is also desirable for the knob to be non-rotatable so that its message be presented, to a user, constantly oriented for easy reading.

Still referring to FIG. 10, the arrangement, as before, includes outlet valve 14A on a lifting stem 15A which carries two lifting collars 25A and 39A. These collars are operable, as previously explained by way of links 24A and 36A.

In this instance however these links are length adjustable. The adjustment may be effected by, for example, providing each with a series of holes 44 any one of which can receive a connecting pin 45 for connection to its collar (25A or 39A).

A pair of standards 46 similarly (that is, with height adjustability) mount the operating mechanism upon the valve-closure float-pot 47 mounted fixedly, relative to the cistern body by being part of or joined to the drain sleeve 11A.

To prevent rotation of the operating knob 17A it is non-rotably secured on the upper end of an operating shaft 48. This shaft is also non-rotatable by reason of lever-operating pin 20A extending diametrically through it. The cistern lid is removably held on the cistern body by hollow screw 49 which threads in stationary sleeve 50.

Shaft 48 is vertically movable within a spring-loaded sleeve 51; the arrangement being such that when the knob 17A is pressed, stem 15A is lifted by collar 25A, and doorway 29A remains open thus initiating a pull flush. When knob 17A is raised, collar 25A is lifted as before, but collar 39A is also raised so to close door 41A on doorway 29A thereby initiating a partial flush.

I claim:

1. A selective-flush operating mechanism for use with apparatus comprising:

a cistern body having a bottom discharge drain aperture and a lid having a hole in it, a closure valve normally seated on said drain, a single press-button extending through said hole, valve lifting means which upon said press-button being depressed causes said closure valve to be lifted from said drain, a float whereby said closure valve is held elevated once lifted and allowed to re-seat on said drain upon conclusion of a flush, and float-controlled means for water-replenishment of said body; said selective-flush operating mechanism comprising:

an open-top partial-flush pot included within said cistern body, said partial-flush pot containing the aperture of said drain, said closure valve and said float, and having a doorway open to the inside of said body adjacent its bottom;

a normally open door for closing said doorway; and a linkage operatively connecting said press-button with said closure valve and said door, such that on lifting said press-button said closure valve is lifted and said door is closed, wherein said linkage is length adjustable to permit adjustment of the overall height of the mechanism.

2. The selective-flush operating mechanism according to claim 1 wherein the adjustment of the linkage includes a row of holes in each link thereof to allow selective engagement of the link with the component engaged therewith.

3. The selective-flush operating mechanism according to claim 1 wherein said press-button is non-rotatable.

4. The selective-flush operating mechanism according to claim 1, wherein said normally open door includes a trickle opening therein.

* * * * *